US011056061B2

(12) United States Patent
Fan et al.

(10) Patent No.: US 11,056,061 B2
(45) Date of Patent: Jul. 6, 2021

(54) ARRAY SUBSTRATES AND DRIVING METHODS THEREOF, AND DISPLAY PANELS

(71) Applicant: KUNSHAN GO-VISIONOX OPTO-ELECTRONICS CO., LTD., Kunshan (CN)

(72) Inventors: Longfei Fan, Kunshan (CN); Hui Zhu, Kunshan (CN)

(73) Assignee: KUNSHAN GO-VISIONOX OPTO-ELECTRONICS CO., LTD., Kunshan (CN)

( * ) Notice: Subject to any disclaimer, the term of this patent is extended or adjusted under 35 U.S.C. 154(b) by 0 days.

(21) Appl. No.: 16/838,040

(22) Filed: Apr. 2, 2020

(65) Prior Publication Data

US 2020/0234649 A1 Jul. 23, 2020

Related U.S. Application Data

(63) Continuation of application No. PCT/CN2019/079144, filed on Mar. 21, 2019.

(30) Foreign Application Priority Data

Sep. 28, 2018 (CN) ..... 201811137492.3

(51) Int. Cl.
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2310/0278* (2013.01); *G09G 2330/028* (2013.01)

(58) Field of Classification Search
CPC ... G09G 2300/0819; G09G 2310/0251; G09G 2310/0278; G09G 2310/0297;
(Continued)

(56) References Cited

U.S. PATENT DOCUMENTS 7,012,580 B2 3/2006 Mizobata
9,740,320 B2 8/2017 Yang et al.
(Continued)

FOREIGN PATENT DOCUMENTS

CN 104269137 A 1/2015
CN 104036723 B 4/2016
(Continued)

OTHER PUBLICATIONS

Search Report of Chinese Patent Application No. 201811137492.3.
(Continued)

*Primary Examiner* — Dmitriy Bolotin
(74) *Attorney, Agent, or Firm* — Kilpatrick Townsend & Stockton

(57) ABSTRACT

The present disclosure relates to an array substrate, including a display area and a non-display area arranged around the display area. The display area includes a plurality of pixel circuits arranged in an array and a first signal line connecting to the pixel circuits. The non-display area includes at least one common circuit and a data driving chip. Each of the common circuits is connected to the pixel circuit through the first signal line, and is configured to provide an initialization signal and a data signal for the pixel circuit. The data driving chip is connected to the common circuit through a second signal line and a third signal line.

18 Claims, 3 Drawing Sheets

(58) Field of Classification Search
CPC ..... G09G 2310/06; G09G 2310/067; G09G 2330/028; G09G 3/3266; G09G 3/3291
See application file for complete search history.

(56) References Cited

U.S. PATENT DOCUMENTS

| | | | | |
|---|---|---|---|---|
| 9,886,906 | B2 | 2/2018 | Tan et al. | |
| 2011/0157126 | A1* | 6/2011 | Chung | G09G 3/3233 345/211 |
| 2016/0105184 | A1 | 4/2016 | Qian et al. | |
| 2016/0189627 | A1* | 6/2016 | Park | G09G 3/3233 345/78 |
| 2016/0267950 | A1 | 9/2016 | Yamamoto et al. | |
| 2017/0154578 | A1* | 6/2017 | In | G09G 3/3283 |
| 2017/0249900 | A1 | 8/2017 | Li et al. | |
| 2017/0259903 | A1 | 8/2017 | Xiang et al. | |
| 2018/0218678 | A1* | 8/2018 | Kwon | G09G 3/3275 |
| 2018/0286310 | A1 | 10/2018 | Yang et al. | |
| 2019/0080652 | A1* | 3/2019 | Kim | G09G 3/3291 |
| 2019/0180693 | A1* | 6/2019 | Kim | G09G 3/3275 |
| 2020/0234649 | A1* | 7/2020 | Fan | G09G 3/3291 |

FOREIGN PATENT DOCUMENTS

| | | | |
|---|---|---|---|
| CN | 104036724 | B | 11/2016 |
| CN | 106097962 | A | 11/2016 |
| CN | 106531085 | A | 3/2017 |
| CN | 106652908 | A | 5/2017 |
| CN | 106910462 | A | 6/2017 |
| CN | 107103878 | A | 8/2017 |
| CN | 109148548 | A | 1/2019 |
| JP | 2004198705 | A | 7/2004 |

OTHER PUBLICATIONS

International Search Report of International Patent Application No. PCT/CN2019/079144.
CN First Office Action with search report dated Sep. 11, 2019 in the corresponding CN application (application No. 201811137492.3).
CN Second Office Action dated Feb. 3, 2020 in the corresponding CN application (application No. 201811137492.3).

* cited by examiner

ARRAY SUBSTRATES AND DRIVING METHODS THEREOF, AND DISPLAY PANELS

CROSS-REFERENCES TO RELATED APPLICATIONS

This application is a continuation application for International Application PCT/CN2019/079144, filed on Mar. 21, 2019, which claims priority to Chinese Patent Application No. 201811137492.3, filed with the Chinese Patent Office on Sep. 28, 2018 and entitled "ARRAY SUBSTRATE AND DISPLAY PANEL", the contents of both applications are incorporated by reference herein for all purposes.

TECHNICAL FIELD

The present disclosure relates to the technical field of display technologies.

BACKGROUND

Because of its advantages of high contrast, low power consumption, wide viewing angle and fast reaction speed, organic emitting display panels are increasingly used in display field. An organic emitting display panel contains pixel circuits arranged in arrays. Generally, in order to achieve high resolution, the size of the pixel circuit is reduced, and the data signal line and the initialization signal line are combined, that is, the data signal and the initialization signal are inputted to the pixel circuit through the same signal line.

SUMMARY

According to various embodiments disclosed in the disclosure, an array substrate and driving method thereof, and a display panel are provided.

An array substrate is provided including a display area and a non-display area arranged around the display area. The display area includes a plurality of pixel circuits arranged in an array and a first signal line connecting to the pixel circuits. The non-display area includes at least one common circuit and a data driving chip. Each of the common circuits is connected to the pixel circuit through the first signal line, and is configured to provide an initialization signal and a data signal for the pixel circuit. The data driving chip is connected to the common circuit through a second signal line and a third signal line. The data driving chip provides the initialization signal to the common circuit through the second signal line, the common circuit receives the initialization signal and initializes the pixel circuit through the first signal line, and the data driving chip provides the data signal to the common circuit through the third signal line, and the common circuit receives the data signal and writes data to the pixel circuit through the first signal line.

In an embodiment, the common circuit includes an initialization circuit and a data writing circuit. The initialization circuit is connected to the data driving chip through the second signal line, and is configured to receive an initialization signal outputted by the data driving chip and transmit the initialization signal to the pixel circuit through the first signal line. The data writing circuit is connected to the data driving chip through the third signal line, and is configured to receive the data signal outputted by the data driving chip and transmit the data signal to the pixel circuit through the first signal line.

In an embodiment, the non-display region further includes a scan driving chip and a first control signal line and a second control signal line connected to the scan driving chip; the scan driving chip provides a first control signal to the initialization circuit through the first control signal line, such that the initialization circuit provides the initialization signal to the pixel circuit when the first control signal is active; the scan driving chip provides a second control signal to the data writing circuit through the second control signal line, such that the data writing circuit provides the data signal to the pixel circuit when the second control signal is active.

In an embodiment, the scan driving chip is connected to the pixel circuit through a scan signal line, and configured to provide a scan signal to the pixel circuit.

In an embodiment, the array substrate further includes a light emitting control chip connected to the pixel circuit through a light emitting control signal line, configured to provide a light emitting control signal for the pixel circuit.

In an embodiment, the initialization circuit includes an initialization transistor; a control end of the initialization transistor is connected to the scan driving chip through the first control signal line, a first pole of the initialization transistor is connected to the pixel circuit through the first signal line, and a second pole of the initialization transistor is connected to the data driving chip through the second signal line; and the data writing circuit includes a data writing transistor, a control end of the data writing transistor is connected to the scan driving chip through the second control signal line, a first pole of the data writing transistor is connected to the pixel circuit through the first signal line, and a second pole of the data writing transistor is connected to the data driving chip through the second signal line.

In an embodiment, the pixel circuit includes a first transistor, a second transistor, a third transistor, a fourth transistor, a fifth transistor, a sixth transistor, a capacitor, and a light emitting diode; a control end of the first transistor is connected to a first pole plate of the capacitor, a second pole of the second transistor, and a first pole of the sixth transistor, a first pole of the first transistor is connected to the first power source, and a second pole of the first transistor is connected to a first pole of the second transistor and a first pole of the third transistor; a control end of the second transistor is connected to a second scanning signal line; a control end of the third transistor is connected to a light emitting control signal line, a second pole of the third transistor is connected to a first pole of the fifth transistor and an anode of the light emitting diode, and a cathode of the light emitting diode is connected to a second power source; a control end of the fifth transistor is respectively connected to a control end of the sixth transistor and a first scanning signal line, and a second pole of the fifth transistor is connected to a second pole of the sixth transistor, a second pole of the fourth transistor, the first pole of the initialization transistor, and the first pole of the data writing transistor; and a control end of the fourth transistor is connected to a third scanning signal line, and a first pole of the fourth transistor is connected to a second pole plate of the capacitor.

In an embodiment, when the first control signal and the first scan signal are active simultaneously, the first control signal controls the initialization transistor to be switched on, the first scan signal controls the fifth transistor and the sixth transistor to be switched on, and the initialization signal initializes the first pole plate of the capacitor, the control end of the first transistor, and the anode of the light emitting diode.

In an embodiment, a voltage of the initialization signal is lower than a supply voltage of the second power source.

In an embodiment, when the third scan signal and the second control signal are active simultaneously, the third scan signal controls the fourth transistor to be switched on, the second control signal controls the data writing transistor to be switched on, and the data signal is written to the second pole of the capacitor through the data writing transistor and the fourth transistor.

In an embodiment, when the third scan signal and the first control signal are active simultaneously, the third scan signal controls the fourth transistor to be switched on, the first control signal controls the initialization transistor to be switched on, and the initialization signal is applied to the control end of the first transistor through the capacitor to compensate a supply voltage provided by the first power source.

In an embodiment, when the light emitting control signal is active, the light emitting control signal controls the third transistor to be switched on and the light emitting diode emits light.

A display panel is provided including the foregoing substrate array.

A method for driving the foregoing array substrate includes:

providing, through a data driving chip, an initialization signal to a common circuit through a second signal line, and receiving, through the common circuit, the initialization signal and initializing the pixel circuit through a first signal line; and providing, through the data driving chip, a data signal to the common circuit through a third signal line, and receiving, through the common circuit, the data signal and writing data to the pixel circuit through the first signal line.

In an embodiment, the common circuit includes an initialization circuit and a data writing circuit, the initialization circuit is connected to the data driving chip through the second signal line, and the data writing circuit is connected to the data driving chip through the third signal line, and the method further includes: receiving, through the initialization circuit, an initialization signal outputted by the data driving chip and transmitting, through the first signal line, the initialization signal to the pixel circuit; and receiving, through the data writing circuit, the data signal outputted by the data driving chip and transmitting the data signal to the pixel circuit through the first signal line.

In an embodiment, the non-display region further includes a scan driving chip and a first control signal line and a second control signal line that are connected to the scan driving chip, and the method further includes: providing, through the scan driving chip, a first control signal to the initialization circuit through the first control signal line, and providing through the initialization circuit, the initialization signal to the pixel circuit when the first control signal is active; and providing, through the scan driving chip, a second control signal to the data writing circuit through the second control signal line, and providing, through the data writing circuit, the data signal to the pixel circuit when the second control signal is active.

In an embodiment, the scanning driving chip is connected to the pixel circuit through a scanning signal line, and the method further includes: providing, through the scan driving chip, a scan signal to the pixel circuit through a scan signal line.

In an embodiment, the array substrate further includes a light emitting control chip connected to the pixel circuit through a light emitting control signal line, and the method further includes: providing, through the light emitting control chip, a light emitting control signal for the pixel circuit through a light emitting control signal line.

The foregoing array substrate and display panel are provided with a common circuit in the non-display area. The data driving chip is connected to the common circuit through the second signal line and the third signal line. In addition, the data driving chip outputs different signals at different time periods, and can provide initialization signals to the common circuit through the second signal line and provide data signals to the common circuit through the third signal line. The common circuit outputs the received signal to the pixel circuit through the first signal line. The present disclosure uses different tracing to output different signals, so as to facilitate the control of the data driving chip, and addresses the problem of display failure caused due to outputting different signals through the same tracing. Meanwhile, in the display area, the common circuit transmits the data signal and the initialization signal respectively to the pixel circuit through the first signal line, that is, the data signal and the initialization signal share the same signal line in the display area, which reduces the density of the screen tracing, thus increasing the aperture rate and realizing the high resolution display.

DETAILED DESCRIPTION OF THE INVENTION

Figure 1:
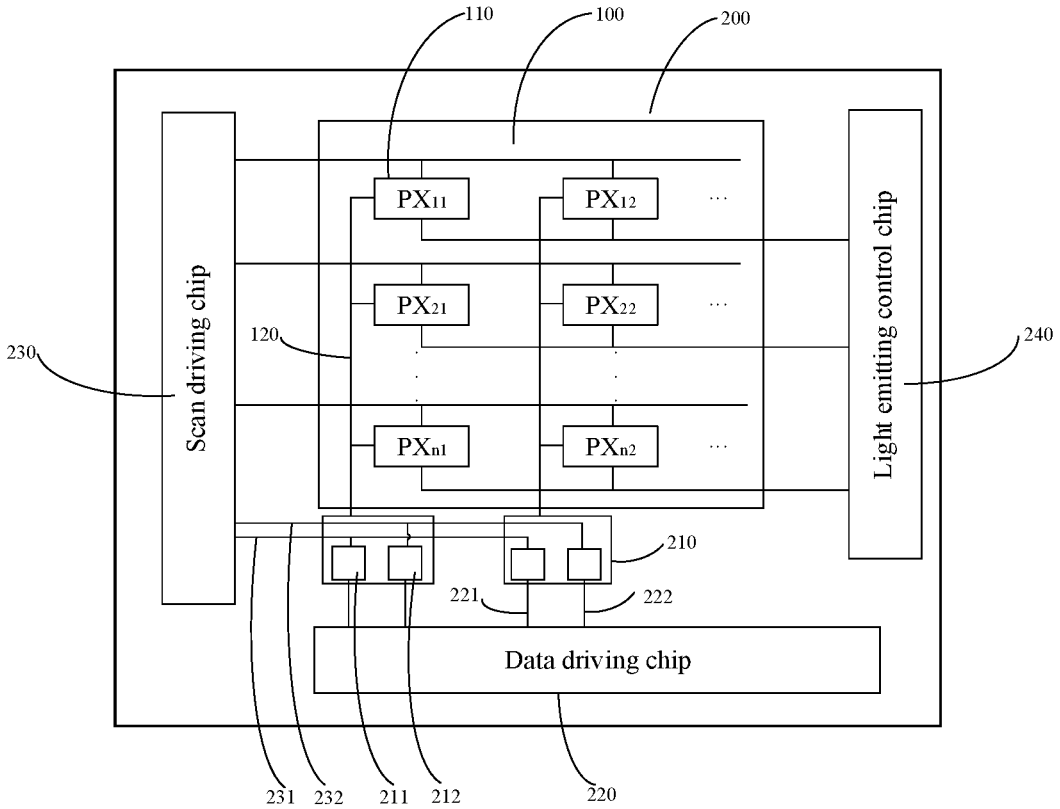
FIG. 1 is a schematic diagram of an array substrate according to an embodiment of the disclosure.

The applicant finds that the driving chip outputs different signals through the same signal line to control the operation of the pixel circuit, which leads to the failure of display panel.

In order to make the foregoing objects, features and advantages of the present disclosure more obvious and easy to understand, the following describes in detail the specific embodiments of the present disclosure with reference to the accompanying drawings. Many specific details are set forth in the following description to facilitate full understanding of the present disclosure. However, the present disclosure can be implemented in many different manners from those described herein. A person skilled in the art may make similar improvements without departing from the connotation of the present disclosure. Therefore, the present disclosure is not limited to the specific embodiments disclosed below.

It should be noted that when a component is referred to as to be "arranged on" another component, it can be directly on another component or it can be a centered component. When one component is considered to be "connected" to another component, it can be connected directly to another component or may exist simultaneously. The terms "vertical", "horizontal", "left", "right" and similar expressions used in this paper are for illustrative purposes only and do not mean the only way to implement them.

An embodiment of the disclosure provides an array substrate, which includes a display area 100 and a non-display area 200 arranged around the display area 100. The display area 100 includes pixel circuits 110 arranged in an array and a first signal line 120 connected to the pixel circuit 110. The non-display area 200 includes common circuits 210, each of common circuits 210 is connected to the pixel circuit 110 through the first signal line 120, to provide an initialization signal and a data signal for the pixel circuits 110. The non-display area 200 further includes a data driving chip 220 connected to the common circuit 210 through a second signal line 221 and a third signal line 222. Further, the data driving chip 220 provides an initialization signal to the common circuit 210 through the second signal line 221. After receiving the initialization signal, the common circuit 210 initializes the pixel circuit 110 through the first signal line 120. The data driving chip 220 provides the data signal to the common circuit 210 through the third signal line 222. After receiving the data signal, the common circuit 210 writes data to the pixel circuit 110 through the first signal line 120. In the embodiment, the data driving chip 220 may output different signals at different time periods, and transmit the signals to the common circuit 210 through the second signal line 221 or the third signal line 222, respectively. It should be noted that the first signal line 120 is located in the display area 100, the second signal line 221 and the third signal line 222 are located in the non-display area 200.

The array substrate provided by the foregoing embodiment is provided with a common circuit 210 in the non-display area 200. The data driving chip 220 is connected to the common circuit 210 through the second signal line 221 and the third signal line 222. In addition, the data driving chip 220 outputs different signals at different time periods, and can provide the initialization signal to the common circuit 210 through the second signal line 221 and the data signal to the common circuit 210 through the third signal line 222. The common circuit 210 outputs the received signal to the pixel circuit 110 through the first signal line 120. In the embodiment, different tracings are configured to output different signals, so as to facilitate the control of the data driving chip 220. This addresses the problem that display failure may be caused due to outputting different signals through the same tracing. Simultaneously, in the display area 100, the common circuit 210 transmits the data signal and the initialization signal to the pixel circuit 110 through the first signal line 120 at different time periods, that is, the data signal and the initialization signal share one signal line in the display area 100, thereby reducing the density of the screen tracing, thereby increasing the aperture rate and realizing high resolution display.

In an embodiment, referring to FIG. 1, the common circuit 210 includes an initialization circuit 211 and a data writing circuit 212. The initialization circuit 211 is connected to the data driving chip 220 through the second signal line 221, and is configured to receive the initialization signal outputted by the data driving chip 220, and transmit the initialization signal to each column of the pixel circuit 110 through the first signal line 120. The data writing circuit 212 is connected to the data driving chip 220 through the third signal line 222, and is configured to receive the data signal outputted by the data driving chip 220 and transmit the data signal to each column of the pixel circuit 110 through the first signal line 120.

In the present embodiment, the output ends of each group of the initialization circuit 211 and the data writing circuit 212 are jointly connected to the same first signal line 120, and are connected to a column of pixel units through the first signal line 120. The initialization circuit 211 and the data writing circuit 212 operate at different time periods, respectively. When the initialization circuit 211 operates, the data writing circuit 212 does not operate, and the initialization circuit 211 receives the initialization signal and transmits the same to the pixel circuit 110 through the first signal line 120. When the data writing circuit 212 is operating, the initialization circuit 211 is not operating, and the data writing circuit 212 receives the data signal and transmits the same to the pixel circuit 110 through the first signal line 120. Therefore, in the embodiment, the data driving chip 220 transmits two types of signals through different signal lines, respectively, which facilitates control and reduces the risk of display failure caused due to outputting different signals through the same tracing. In one of the embodiments, the non-display area 200 of the array substrate further includes a scan driving chip 230, and a first control signal line 231 and a second control signal line 232 connected to the scan driving chip 230. The scan driving chip 230 provides the first control signal to the initialization circuit 211 through the first control signal line 231, such that the initialization circuit 211 provides the initialization signal to each column of the pixel circuit 110 when the first control signal is active. The scan driving chip 230 provides a second control signal to the data writing circuit 212 through the second control signal line 232, such that the data writing circuit 212 provides the data signal to each column of pixel circuit 110 when the second control signal is active.

Specifically, the scan driving chip 230 is connected to the control end of the initialization circuit 211 through the first control signal line 231, and is connected to the control end of the data writing circuit 212 through the second control signal line 232. The scan driving chip 230 outputs the first control signal and transmits the first control signal to the control end of the initialization circuit 211 through the first control signal line 231, such that the initialization circuit 211 is switched on, and the initialization signal may be transmitted to the pixel circuit 110 through the initialization circuit 211. The scan driving chip 230 outputs the second control signal and transmits the second control signal to the control end of the data writing circuit 212 through the second control signal line 232, such that the data writing circuit 212 is switched on, such that the data signal may be transmitted to the pixel circuit 110 through the data writing circuit 212 to write the data signal to the pixel circuit 110.

Further, the scan driving chip 230 is further connected to each row of pixel circuits 110 through a scan signal line, and configured to provide a scan signal for each row of pixel circuits 110. The array substrate further includes a light emitting control chip 240 connected to each row of pixel circuits 110 through a light emitting control signal line, and is configured to provide a light emitting control signal for each row of pixel circuits 110.

It should also be noted that in the above-described embodiment of FIG. 1, the plurality of pixel circuits 110 are arranged in arrays in a form of rows and columns, for example, $PX_{11}$, $PX_{21}$, . . . , $PX_{nm}$ (not all shown in FIG. 1). However, it should be understood that, without departing from the inventive concept, the array arrangement of the pixel circuits 110 may be in other forms.

The data driving chip 220, the scanning driving chip 230 and the light emitting control chip 240 may be independent control chips, or may be integrated into the same control chip.

Figure 2:
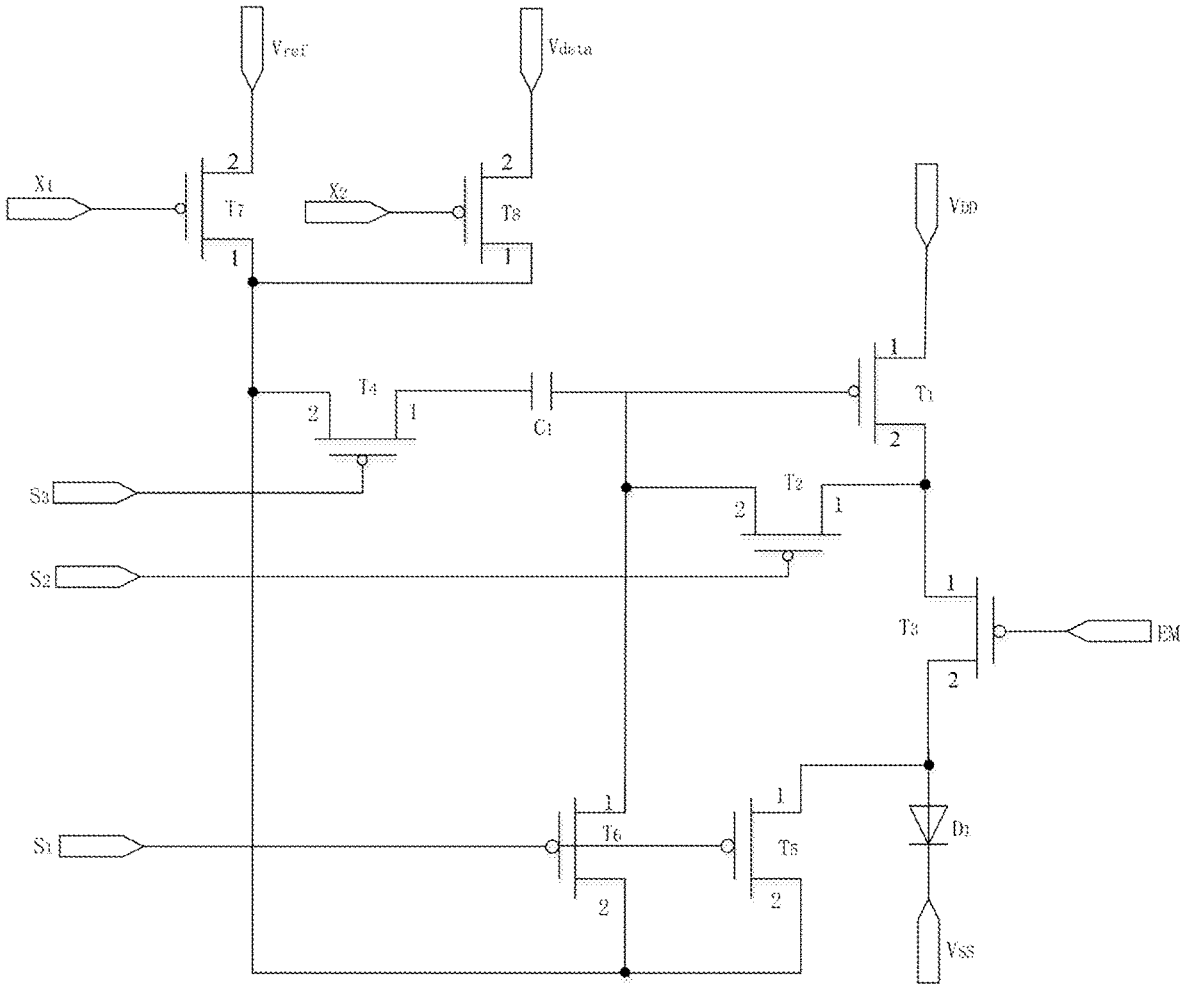
FIG. 2 is a schematic diagram of a pixel circuit according to an embodiment of the disclosure.

In an embodiment, referring to FIG. 2, the initialization circuit 211 includes an initialization transistor $T_7$, and the data writing circuit 212 includes a data writing transistor $T_8$. The control end of the initialization transistor $T_7$ is connected to the scan driving chip 230 through the first control signal line 231, the first pole of the initialization transistor $T_7$ is connected to the pixel circuit 110 through the first signal line 120, and the second pole of the initialization transistor $T_7$ is connected to the data driving chip 220 through the second signal line 221. The control end of the data writing transistor $T_8$ is connected to the scan driving chip 230 through the second control signal line 232, the first pole of the data writing transistor $T_8$ is connected to the pixel circuit 110 through the first signal line 120, and the second pole of the data writing transistor $T_8$ is connected to the data driving chip 220 through the third signal line 222. In alternative embodiments, the initialization circuit 211 and the data writing circuit 212 may also be other circuits capable of transmitting initialization signals and data signals, respectively, which is not limited hereto.

In the embodiment, both the initialization transistor $T_7$ and the data writing transistor $T_8$ may be P-type transistors. The first control signal and the second control signal outputted by the scan driving chip 230 may be low-level signals, and the first control signal and the second control signal may respectively control the initialization transistor $T_7$ and the data writing transistor $T_8$ to be switched on, such that the initialization signal or the data writing transistor $T_7$ or the data writing transistor $T_8$ may be written into the pixel circuit 110.

Referring to FIG. 2, in one of the embodiments, the pixel circuit 110 includes a first transistor $T_1$, a second transistor $T_2$, a third transistor $T_3$, a fourth transistor $T_4$, a fifth transistor $T_5$, a sixth transistor $T_6$, a capacitor $C_1$, and a light emitting diode $D_1$.

The control end of the first transistor $T_1$ is connected to the first pole of the capacitor $C_1$, the second pole of the second transistor $T_2$, and the first pole of the sixth transistor $T_6$. The first pole of the first transistor $T_1$ is connected to a first power source $V_{DD}$. And the second pole of the first transistor $T_1$ is connected to the first pole of the second transistor $T_2$ and the first pole of the third transistor $T_3$. The control end of the second transistor $T_2$ is connected to the second scanning signal line. The control end of the third transistor $T_3$ is connected to the light emitting control signal line, and the second pole of the third transistor $T_3$ is connected to the first pole of the fifth transistor $T_5$ and the $D_1$ anode of the light emitting diode. The cathode of the light emitting diode $D_1$ is connected to a second power source $V_{SS}$. The control end of the fifth transistor $T_5$ is connected to the control end of the sixth transistor $T_6$ and the first scanning signal line respectively, and the second pole of the fifth transistor $T_5$ is connected to the second pole of the sixth transistor $T_6$, the second pole of the fourth transistor $T_4$, the first pole of the initialization transistor $T_7$, and the first pole of the data writing transistor $T_8$. The control end of the fourth transistor $T_4$ is connected to the third scanning signal line, and the first pole of the fourth transistor $T_4$ is connected to the second pole plate of the capacitor $C_1$.

In the embodiment, the second transistor $T_2$, the third transistor $T_3$, the fourth transistor $T_4$, the fifth transistor $T_5$, and the sixth transistor $T_6$ of the pixel circuit 110 are all switching transistors, and the first transistor $T_1$ is a driving transistor. The capacitor $C_1$ is an energy storage capacitor and light emitting diode $D_1$ is an organic light-emitting diode (OLED). The transistors in the embodiment are all P-type transistors, and the control end is the gate of the transistor, the first pole is the source of the first transistor, and the second pole is the drain of the second transistor, a low level is applied to the control end of the transistor to switch on the transistor. Since the thin film transistor is a symmetrical device, the first and second poles are interchangeable. Of course, in other embodiments, the transistor may also be an N-type transistor, and when an N-type transistor is used as a transistor in the pixel circuit 110, a high level signal is inputted to the control end of the transistor to switch it on.

The first power source $V_{DD}$ may be a positive voltage and is configured to provide a power source voltage to the first transistor $T_1$. The first transistor $T_1$ outputs current under the action of the first power source $V_{DD}$. The current flows into the light emitting diode $D_1$ to enable the light emitting diode $D_1$ to emit light. When the light emitting diode $D_1$ is emitting light, the current flows into the second power source $V_{SS}$, which may be a negative voltage.

In the circuit shown in FIG. 2, $S_1$ is the first scan signal transmitted by the first scan signal line, $S_2$ is the second scan signal transmitted by the second scan signal line, $S_3$ is the third scan signal transmitted by the third scan signal line, EM is the light emission control signal transmitted by the light emission control signal line, $X_1$ is the first control signal transmitted by the first control signal line 231, and $X_2$ is the second control signal transmitted by the second control signal line 232.

The first scanning signal line is connected to the control ends of the fifth transistor $T_5$ and the sixth transistor $T_6$, and is configured to input the first scanning signal to the control ends of the fifth transistor $T_5$ and the sixth transistor $T_6$ to control on and off of the fifth transistor $T_5$ and the sixth transistor $T_6$. The second scanning signal line is connected to the control end of the second transistor $T_2$, and is configured to input a second scanning signal to the control end of the second transistor $T_2$ to control the on and off of the second transistor $T_2$. The third scanning signal line is connected to the control end of the fourth transistor $T_4$, and is configured to input a third scanning signal to the control end of the fourth transistor $T_4$ to control the on and off of the fourth transistor $T_4$. The first control signal line 231 is connected to the control end of the initialization transistor $T_7$, and is configured to input a first control signal to the control end of the initialization transistor $T_7$ to control the on and off of the initialization transistor $T_7$. The second control signal line 232 is connected to the control end of the data writing transistor $T_8$, and is configured to input a second control signal to the control end of the data writing transistor $T_8$ to control the on and off of the data writing transistor $T_8$.

When the first control signal and the first scan signal are both active, the first scan signal controls the fifth transistor $T_5$ and the sixth transistor $T_6$ to be in an on state, and the first control signal controls the initialization transistor $T_7$ to be in the on state. The initialization signal is transmitted to the pixel circuit 110 through the initialization transistor $T_7$, and initializes the control end of the first pole plate and the first transistor $T_1$ of the capacitor $C_1$ through the sixth transistor $T_6$, such that the data can be written to the capacitor $C_1$. Meanwhile, the initialization signal initializes the anode of the light emitting diode $D_1$ through the fifth transistor $T_5$. It should be noted that the voltage of the initialization signal is lower than the voltage of the power source of the second power source $V_{SS}$ to prevent the light emitting diode $D_1$ from emitting at the initialization stage.

When the second scan signal, the third scan signal and the second control signal are simultaneously active, the second scan signal controls the second transistor $T_2$ to be in the on state, the third scan signal controls the fourth transistor $T_4$ to be in the in the on state, the second control signal controls the data writing transistor $T_8$ to be in the on state, and the data signal is written to the second pole of the capacitor $C_1$ through the data writing transistor $T_8$ and the fourth transistor $T_4$.

When the third scan signal and the first control signal are both, the third scan signal controls the fourth transistor $T_4$ to be in the on state, the first control signal controls the initialization transistor $T_7$ to be in the on state, the initialization signal is applied to the control end of the first transistor $T_1$ through the capacitor $C_1$, and the supply voltage provided by the first power source $V_{DD}$ is compensated, such that the current flowing through the first transistor $T_1$ is independent of the supply voltage of the first power source $V_{DD}$.

When the light emitting control signal is active, the light emitting control signal controls the third transistor $T_3$ to be in the on state, and the current flows through the light emitting diode $D_1$ to enable the light emitting diode $D_1$ to emit light.

Figure 3:
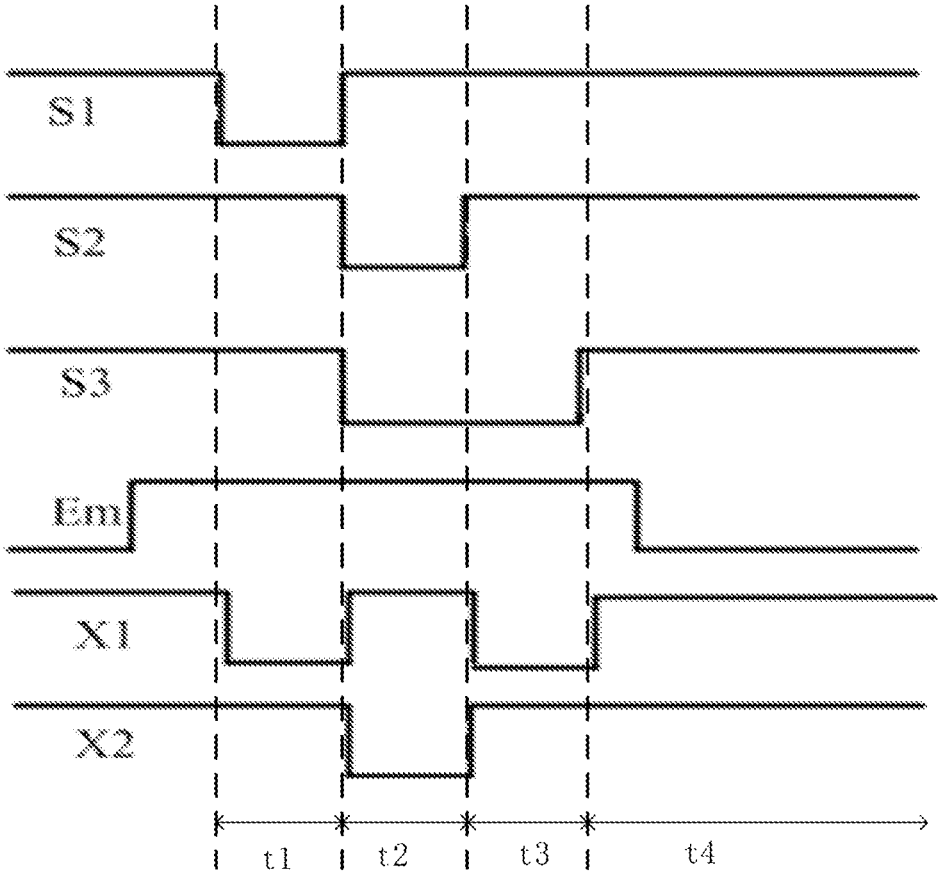
FIG. 3 is a sequence signal chart of a pixel circuit according to an embodiment of the disclosure.

FIG. 3 is an operation sequence chart of the pixel circuit 110 according to an embodiment of the present disclosure. Based on FIGS. 2 and 3, the operating principle of the pixel circuit 110 is as follows:

In an initialization stage t1, the first scan signal and the first control signal are low-level signals, and the second scan signal, the third scan signal, the light-emitting control signal, and the second control signal are high-level signals. The initialization transistor $T_7$, the fifth transistor $T_5$ and the sixth transistor $T_6$ are switched on, and the data writing transistor $T_8$, the second transistor $T_2$, the third transistor $T_3$, and the fourth transistor $T_4$ are switched off.

Since the initialization transistor $T_7$ is switched on, the initialization signal enters the pixel circuit 110 through the transistor $T_7$ and the first signal line 120 connected to the transistor $T_7$. The initialization signal initializes the control end of the first transistor $T_1$ and the first pole plate of the capacitor $C_1$ through the sixth transistor $T_6$. The initialization signal may be, for example, the first reference voltage $V_{ref}$. The first reference voltage $V_{ref}$ may be a negative voltage. The first reference voltage $V_{ref}$ acts on the control end of the first transistor $T_1$ to switch on the first transistor $T_1$. Since the fifth transistor $T_5$ is switched on, the initialization signal can initialize the anode of the light emitting diode $D_1$.

In a data writing stage t2, the second scan signal, the third scan signal, and the second control signal are low-level signals, and the first scan signal, the first control signal, and the light-emitting control signal are high-level signals. The data writing transistor $T_8$, the second transistor $T_2$ and the fourth transistor $T_4$ are switched on, and in the initialization phase, the first transistor $T_1$ is switched on. The third transistor $T_3$, the fifth transistor $T_5$, the sixth transistor $T_6$ and the initialization transistor $T_7$ are switched off.

Because the first transistor $T_1$ is switched on, the power source voltage of the first power source $V_{DD}$ is written to the first pole of the first transistor $T_1$. The voltage of the first pole of the first transistor $T_1$ continuously rises until the first transistor $T_1$ is in a critical state between off and on. At this time, the potential of the first pole of the first transistor $T_1$ is $V_{DD}$, and the potential of the control end is $V_{DD}-|V_{th}|$, thus compensating the threshold voltage of the first transistor $T_1$. Since the data writing transistor $T_8$ is switched on, the data signal enters the pixel circuit 110 through the data writing transistor $T_8$. Since the fourth transistor $T_4$ is switched on, the data signal is written to the second pole plate of the capacitor $C_1$ through the fourth transistor $T_4$, such that the potential of the second pole plate of the capacitor $C_1$ is $V_{data}$.

At compensation stage t3, the third scan signal and the first control signal are low level signals, the first scan signal, the second scan signal, the light emitting control signal, and the second control signal are high level signals, the fourth transistor $T_4$ and the initializing transistor $T_7$ are switched on, the second transistor $T_2$, the third transistor $T_3$, the sixth transistor $T_6$, the fifth transistor $T_5$ and the data writing transistor $T_8$ are switched off.

Since the initializing transistor $T_7$ is switched on, the initializing voltage is written to the second pole plate of the capacitor $C_1$ through the initializing transistor $T_7$ and the fourth transistor $T_4$, thus the potential of the second pole plate of the capacitor $C_1$ is changed from $V_{data}$ to $V_{ref}$. Since the second transistor $T_2$ and the sixth transistor $T_6$ are switched off, the voltage difference between the two ends of the capacitor $C_1$ remains unchanged. According to the principle of capacitance coupling, when the voltage difference of the capacitor $C_1$ remains unchanged, the potential of the first pole plate of the capacitor $C_1$ also changes with the change of the potential of the second pole plate. Since the control end of the first transistor $T_1$ is connected to the first pole plate of the capacitor $C_1$, the control end potential variation amount of the first transistor $T_1$ is $V_{ref}-V_{data}$. Therefore, the potential of the control end of the first transistor $T_1$ is $V_{DD}-|V_{th}|+V_{ref}-V_{data}$.

In a light emitting stage t4, the light emitting control signal is a low level signal, and the first scanning signal, the second scanning signal, the third scanning signal, the first control signal, and the second control signal are all high level signals. The third transistor $T_3$ is switched on, the second transistor $T_2$, the fourth transistor $T_4$, the sixth transistor $T_6$, the fifth transistor $T_5$, the initialization transistor $T_7$, and the data writing transistor $T_8$ are switched off. Since the third transistor $T_3$ is switched on, the circuit from the first power source $V_{DD}$, the first transistor $T_1$, the third transistor $T_3$, the light emitting diode $D_1$ to the second power source $V_{SS}$ is switched on.

The current flowing through the first transistor $T_1$ is:

$$I=K*(V_{gs}-V_{th})^2=K*(V_{DD}-|V_{th}|+V_{ref}-V_{data}-V_{DD}+|V_{th}|)^2$$

$$=K*(V_{ref}-V_{data})$$

$K=\frac{1}{2}*\mu*C_{ox}*W/L$. $\mu$ is the electron mobility of the first transistor $T_1$, $C_{ox}$ is the gate oxide capacitance of the unit area of the first transistor $T_1$, W is the channel width of the first transistor $T_1$, and L is the channel length of the first transistor $T_1$. The driving current flowing through the first transistor $T_1$ is the light emitting current flowing through the light emitting diode $D_1$. It can be seen from the above formula that the light emitting current flowing through the light emitting diode $D_1$ is independent of the voltage of the first power source $V_{DD}$, the threshold voltage of the transistor, and dependent on the voltage value of the initialization signal. Therefore, according to the array substrate provided in the embodiments of the disclosure, the circuit structure of the array substrate can use the initialization signal to compensate a current-resistance voltage drop on a first power line. Meanwhile, the foregoing circuit structure and control method also compensate an influence of the threshold voltage to the luminous current, thereby improving the uniformity of luminous emission of the screen body. The array substrate data driving 220 is connected to the initialization transistor $T_7$ and the data writing transistor $T_8$ through the second signal line 221 and the third signal line 222, respectively. Different signals are transmitted through different signal lines, which makes it easy to control and prevents display failure. In the display area 100, both the initialization transistor $T_7$ and the data writing transistor $T_8$ input signals to the pixel circuit 110 through the first signal line 120, thereby reducing the tracing density of the screen body and further improving the resolution of the screen body.

It should be understood that, the data driving chip 220, the scan driving chip 230, and the light emitting control chip 240 may include at least one memory that stores a computer program and at least one processor that executes the computer program. The implementation of all or part of the process in the method of the above embodiment may be accomplished by hardware instructed by a computer program that may be stored in a non-temporary computer-readable storage medium. Embodiments of all the methods described above may be executed when a computer program is executed. Any reference to a memory, database or other medium used in the embodiments provided herein may include non-temporary and/or temporary memory. Non-volatile memory may include read-only memory (ROM), programmable ROM (PROM), electrically programmable ROM (EPROM), electrically erasable programmable ROM (EEPROM), or flash memory. Volatile memory may include random access memory (RAM) or external cache memory. RAM is available in various forms, such as static RAM (SRAM), dynamic RAM (DRAM), synchronous DRAM (SDRAM), double data rate SDRAM (DDRSDRAM), enhanced SDRAM (ESDRAM), synchronous link (Synchlink), DRAM (SLDRAM), Rambus direct RAM (RDRAM), direct memory bus dynamic RAM (DRDRAM), and memory bus dynamic RAM (RDRAM).

The foregoing respective technical features involved in the respective embodiments can be combined arbitrarily, for brevity, not all possible combinations of the respective technical features in the foregoing embodiments are described, however, to the extent they have no collision with each other, the combination of the respective technical features shall be considered to be within the scope of the description.

The foregoing implementations are merely specific embodiments of the present disclosure, and are not intended to limit the protection scope of the present disclosure. It should be noted that any variation or replacement readily figured out by persons skilled in the art within the technical scope disclosed in the present disclosure shall all fall into the protection scope of the present disclosure. Therefore, the protection scope of the present disclosure shall be subject to the protection scope of the claims.

The invention claimed is:

1. An array substrate, comprising:

a display area having a plurality of pixel circuits arranged in an array and a first signal line connecting the pixel circuits; and a non-display area arranged around the display area, the non-display area including:

a plurality of common circuits, wherein each of common circuits is connected to the plurality of pixel circuits through the first signal line, and is configured to provide an initialization signal and a data signal for the plurality of pixel circuits; and a data driving chip connected to the plurality of common circuits through a second signal line and a third signal line, and configured to provide the initialization signal and the data signal for the plurality of common circuits; and wherein the pixel circuits comprise a first transistor, a second transistor, a third transistor, a fourth transistor, a fifth transistor, a sixth transistor, a capacitor, and a light emitting diode;

wherein:

a control end of the first transistor is connected to a first pole plate of the capacitor, a second pole of the second transistor, and a first pole of the sixth transistor, a first pole of the first transistor is connected to a first power source, and a second pole of the first transistor is connected to a first pole of the second transistor and a first pole of the third transistor;

a control end of the second transistor is connected to a second scan signal line configured to input a second scan signal;

a control end of the third transistor is connected to a light emitting control signal line, a second pole of the third transistor is connected to a first pole of the fifth transistor and an anode of the light emitting diode, and a cathode of the light emitting diode is connected to a second power source;

a control end of the fifth transistor is respectively connected to a control end of the sixth transistor and a first scan signal line configured to input a first scan signal, and a second pole of the fifth transistor is connected to a second pole of the sixth transistor, a second pole of the fourth transistor, a first pole of an initialization transistor of an initialization circuit connected to the data driving chip through the second signal line, and a first pole of a data writing transistor of a data writing circuit connected to the data driving chip through the third signal line; and a control end of the fourth transistor is connected to a third scan signal line configured to input a third scan signal, and a first pole of the fourth transistor is connected to a second pole plate of the capacitor.

2. The array substrate according to claim 1, wherein the plurality of common circuits comprises:

the initialization circuit connected to the data driving chip through the second signal line, and configured to receive the initialization signal outputted by the data driving chip and transmit the initialization signal to the pixel circuits through the first signal line; and the data writing circuit connected to the data driving chip through the third signal line, and configured to receive the data signal outputted by the data driving chip and transmit the data signal to the pixel circuits through the first signal line.

3. The array substrate according to claim 2, wherein the non-display area further comprises a scan driving chip, and a first control signal line and a second control signal line connected to the scan driving chip;

the scan driving chip provides a first control signal to the initialization circuit through the first control signal line, such that the initialization circuit provides the initialization signal to the pixel circuits when the first control signal is active;

the scan driving chip provides a second control signal to the data writing circuit through the second control signal line, such that the data writing circuit provides the data signal to the pixel circuits when the second control signal is active.

4. The array substrate according to claim 3, wherein the scan driving chip is connected to the pixel circuits through a scan signal line, and configured to provide a scan signal to the pixel circuit.

5. The array substrate according to claim 3, further comprising a light emitting control chip connected to the pixel circuits through a light emitting control signal line, and configured to provide a light emitting control signal for the pixel circuits.

6. The array substrate according to claim 3, wherein the initialization circuit comprises the initialization transistor, a control end of the initialization transistor is connected to the scan driving chip through the first control signal line, a first pole of the initialization transistor is connected to the pixel circuits through the first signal line, and a second pole of the initialization transistor is connected to the data driving chip through the second signal line; and the data writing circuit comprises the data writing transistor, a control end of the data writing transistor is connected to the scan driving chip through the second control signal line, a first pole of the data writing transistor is connected to the pixel circuits through the first signal line, and a second pole of the data writing transistor is connected to the data driving chip through the third signal line.

7. The array substrate according to claim 2, wherein when the first control signal and the first scan signal are active simultaneously, the first control signal controls the initialization transistor to be switched on, the first scan signal controls the fifth transistor and the sixth transistor to be switched on, and the initialization signal initializes the first pole plate of the capacitor, the control end of the first transistor, and the anode of the light emitting diode.

8. The array substrate according to claim 7, wherein a voltage of the initialization signal is lower than a supply voltage of the second power source.

9. The array substrate according to claim 8, wherein when the third scan signal and the second control signal are active simultaneously, the third scan signal controls the fourth transistor to be switched on, the second control signal controls the data writing transistor to be switched on, and the data signal is written to the second pole of the capacitor through the data writing transistor and the fourth transistor.

10. The array substrate according to claim 9, wherein when the third scan signal and the first control signal are active simultaneously, the third scan signal controls the fourth transistor to be switched on, the first control signal controls the initialization transistor to be switched on, and the initialization signal is applied to the control end of the first transistor through the capacitor to compensate a supply voltage provided by the first power source.

11. The array substrate according to claim 10, wherein when the light emitting control signal is active, the light emitting control signal controls the third transistor to be switched on and the light emitting diode emits light.

12. A display panel comprising the array substrate according to claim 1.

13. A method for driving an array substrate, the method comprising:

providing, through a data driving chip, an initialization signal to a common circuit through a second signal line, and receiving, through the common circuit, the initialization signal and initializing a pixel circuit through a first signal line; and providing, through the data driving chip, a data signal to the common circuit through a third signal line, and receiving, through the common circuit, the data signal and writing data to the pixel circuit through the first signal line;

wherein the pixel circuit comprises a first transistor, a second transistor, a third transistor, a fourth transistor, a fifth transistor, a sixth transistor, a capacitor, and a light emitting diode; wherein a control end of the fifth transistor is respectively connected to a control end of the sixth transistor and a first scan signal line configured to input a first scan signal, and a second pole of the fifth transistor is connected to a second pole of the sixth transistor, a second pole of the fourth transistor, a first pole of an initialization transistor of an initialization circuit connected to the data driving chip through the second signal line, and a first pole of a data writing transistor of a data writing circuit connected to the data driving chip through the third signal line; wherein the method further comprises:

providing, through the first signal line, the first scan signal to control the fifth transistor and the sixth transistor to be in an on state and providing, through a control signal line, a control signal to control the initialization transistor to be in the on state, when the first scan line and the control signal line are both active.

14. The method according to claim 13, wherein the common circuit comprises the initialization circuit and the data writing circuit, the initialization circuit is connected to the data driving chip through the second signal line, and the data writing circuit is connected to the data driving chip through the third signal line, and the method further comprises:

receiving, through the initialization circuit, an initialization signal outputted by the data driving chip and transmitting, through the first signal line, the initialization signal to the pixel circuit; and receiving, through the data writing circuit, the data signal outputted by the data driving chip and transmitting the data signal to the pixel circuit through the first signal line.

15. The method according to claim 14, wherein a non-display region comprises a scan driving chip and a first control signal line and a second control signal line that are connected to the scan driving chip, and the method further comprises:

providing, through the scan driving chip, a first control signal to the initialization circuit through the first control signal line, and providing through the initialization circuit, the initialization signal to the pixel circuit when the first control signal is active; and providing, through the scan driving chip, a second control signal to the data writing circuit through the second control signal line, and providing, through the data writing circuit, the data signal to the pixel circuit when the second control signal is active.

16. The method according to claim 15, wherein the scanning driving chip is connected to the pixel circuit through a scan signal line, and the method further comprises:

providing, through the scan driving chip, a scan signal to the pixel circuit through a scan signal line.

17. The method according to claim 15, wherein the array substrate further comprises a light emitting control chip connected to the pixel circuit through a light emitting control signal line, and the method further comprises:

providing, through the light emitting control chip, a light emitting control signal for the pixel circuit through a light emitting control signal line.

18. An array substrate, comprising:

a display area having a plurality of pixel circuits arranged in an array and a first signal line connecting the pixel circuits; and a non-display area arranged around the display area, the non-display area including:

a plurality of common circuits, wherein each of common circuits is connected to the plurality of pixel circuits through the first signal line, and is configured to provide an initialization signal and a data signal for the plurality of pixel circuits; and a data driving chip connected to the plurality of common circuits through a second signal line and a third signal line, and configured to provide the initialization signal and the data signal for the plurality of common circuits; and wherein the pixel circuits comprise a first transistor, a second transistor, a third transistor, a fourth transistor, a fifth transistor, a sixth transistor, a capacitor, and a light emitting diode;

wherein:

a control end of the first transistor is connected to a first pole plate of the capacitor, a second pole of the second transistor, and a first pole of the sixth transistor, a first pole of the first transistor is connected to a first power source, and a second pole of the first transistor is connected to a first pole of the second transistor and a first pole of the third transistor;

a control end of the third transistor is connected to a light emitting control signal line, a second pole of the third transistor is connected to a first pole of the fifth transistor and an anode of the light emitting diode, and a cathode of the light emitting diode is connected to a second power source; and a control end of the fifth transistor is respectively connected to a control end of the sixth transistor and a first scan signal line, and a second pole of the fifth transistor is connected to a second pole of the sixth transistor, a second pole of the fourth transistor, a first pole of an initialization transistor of an initialization circuit connected to the data driving chip through the second signal line, and a first pole of a data writing transistor of a data writing circuit that is connected to the data driving chip through the third signal line.

* * * * *